US009187928B2

(12) United States Patent
Abel et al.

(10) Patent No.: US 9,187,928 B2
(45) Date of Patent: Nov. 17, 2015

(54) DOOR LOCK INDICATOR

(71) Applicant: PDQ MANUFACTURING, Leola, PA (US)

(72) Inventors: Jason S. Abel, Lititz, PA (US); Gerald J. Wingle, Jr., Reinholds, PA (US)

(73) Assignee: PDQ Manufacturing, Leola, PA (US)

( * ) Notice: Subject to any disclaimer, the term of this patent is extended or adjusted under 35 U.S.C. 154(b) by 97 days.

(21) Appl. No.: 14/244,962

(22) Filed: Apr. 4, 2014

(65) Prior Publication Data

US 2014/0311197 A1 Oct. 23, 2014

Related U.S. Application Data

(60) Provisional application No. 61/813,210, filed on Apr. 18, 2013.

(51) Int. Cl.

| | |
|---|---|
| ***E05B 41/00*** | (2006.01) |
| ***E05B 17/10*** | (2006.01) |
| ***E05B 17/22*** | (2006.01) |
| ***E05B 15/02*** | (2006.01) |

(52) U.S. Cl.

CPC ..... *E05B 41/00* (2013.01); *E05B 15/02* (2013.01); *E05B 17/10* (2013.01); *E05B 17/22* (2013.01); *Y10T 70/8027* (2015.04)

(58) Field of Classification Search

CPC ..... E05B 17/10; E05B 17/22; E05B 41/00; E05B 45/06; Y10T 70/8027; G07C 1/32

USPC ..... 70/432, 434, 441, DIG. 30; 340/542, 340/691.1, 686.1, 815.45

See application file for complete search history.

(56) References Cited

U.S. PATENT DOCUMENTS

| | | | | |
|---|---|---|---|---|
| 871,126 | A | 11/1907 | Lockett | |
| 943,637 | A | 12/1909 | Schoell | |
| 1,145,206 | A * | 7/1915 | Moore | E05B 13/004 200/61.64 |
| 4,490,999 | A * | 1/1985 | Castle | E05B 41/00 70/330 |
| 4,559,796 | A | 12/1985 | De Forrest, Sr. | |
| 4,683,741 | A | 8/1987 | Fields | |
| 4,760,380 | A | 7/1988 | Quenneville et al. | |
| 5,111,007 | A | 5/1992 | Miller et al. | |
| 5,933,086 | A * | 8/1999 | Tischendorf | E05B 47/0661 340/12.22 |
| 6,354,122 | B1 | 3/2002 | Snoke | |
| 6,363,763 | B1 * | 4/2002 | Geringer | E05B 45/12 70/432 |
| 6,860,129 | B2 | 3/2005 | Eller et al. | |
| 6,938,445 | B2 | 9/2005 | Huang | |

(Continued)

OTHER PUBLICATIONS

Schlage, "Standalone Classroom Lockdown Solution User Guide and Product Specifications", CO-220-75 Function, Ingersoll Rand, 2013, 6 pages.

*Primary Examiner* — Suzanne Barrett

(74) *Attorney, Agent, or Firm* — McNees Wallace & Nurick LLC

(57) ABSTRACT

A door lock indicator and method for use by occupants in an interior space to confirm if a lock of a door handle of a door is in a locked or an unlocked position. An inside handle of the door handle must always be free to open the door for immediate exit. When a locking mechanism is in a first position, the locking mechanism aligns with an indicator mechanism to provide an indication that the door handle is in the unlocked position. When the locking mechanism is in a second position, the locking mechanism does not align with the indicator mechanism to provide an indication that the door handle is the locked position.

20 Claims, 9 Drawing Sheets

(56) References Cited

U.S. PATENT DOCUMENTS

| | | | | |
|---|---|---|---|---|
| 7,172,306 | B1 | 2/2007 | Campa | |
| 7,248,163 | B2 | 7/2007 | Wu | |
| 7,501,930 | B2 | 3/2009 | Cote et al. | |
| 7,714,739 | B2 | 5/2010 | Schensky | |
| 7,866,195 | B2 | 1/2011 | Levine | |
| 8,037,725 | B2 | 10/2011 | Levine | |
| 8,325,039 | B2 | 12/2012 | Picard et al. | |
| 9,057,209 | B2 * | 6/2015 | Eichenstein | E05B 41/00 |
| 2003/0063009 | A1 * | 4/2003 | Pelletier | E05B 41/00 340/686.1 |
| 2006/0144103 | A1 | 7/2006 | Blanch | |
| 2007/0214848 | A1 * | 9/2007 | Meyerle | E05B 47/0011 70/278.2 |
| 2010/0313612 | A1 * | 12/2010 | Eichenstein | E05B 15/0205 70/124 |
| 2013/0145802 | A1 * | 6/2013 | Eichenstein | E05B 41/00 70/432 |
| 2014/0353980 | A1 * | 12/2014 | Beck | E05B 41/00 292/145 |
| 2015/0225982 | A1 * | 8/2015 | Bronner | E05B 41/00 70/432 |

* cited by examiner

DOOR LOCK INDICATOR

FIELD OF THE INVENTION

This invention is directed to a door lock indicator. In particular, the invention is directed to an indicator which visually indicates if the door lock is in a passageway mode or a safety mode.

BACKGROUND OF THE INVENTION

Traditionally, a door lock has been able to adopt a locked mode and an unlocked mode, typically by turning a key in the lock. More recently, locks have become more sophisticated and have multiple modes. These modes may include a "passage mode" by which is meant that the door can be opened from the inside and the outside simply by operating the door handle, a "safety mode" by which is meant that the door is locked from one side (typically the outside) but can be opened from the inside by turning the handle, and a "secure mode" by which is meant that the door is locked from both the inside and the outside.

It is well-known to provide a "safety mode" mechanism that enables the door to be operated from the inside but not from the outside. This type of mechanism is commonly used on external doors and interior doors, such as, but not limited to, school room doors, bathroom doors and the like. Such doors often have an indicator on the outside of a door to let the person on the outside of the door know if the door is locked. A very well-known example is the public toilet door lock which has an "engaged/vacant" indicator which is operated from the inside of the door and upon locking of the door.

In many instances, such as, but not limited to, in school classrooms, it is beneficial to have a lock mechanism which can be locked or unlocked from the outside lever or handle. However, for safety reasons, the inside lever or handle must always be free to open the door for immediate exit, whether the outside handle is locked or unlocked. It is also beneficial to have a lock mechanism which can be locked from the inside handle, while still allowing the inside handle to be free to open the door for immediate exit. However, because the key on either side rotates 360-degrees to lock or unlock the mechanism and as the inside handle must remain free, it is difficult for a user positioned proximate the inside handle to know if the mechanism is locked or unlocked. This can prove disastrous in instances in which there is danger outside of the classroom and the occupants of the classroom want to confirm that the lock mechanism is in the locked position.

It would, therefore, be beneficial to provide a door lock indicator which can be used by occupants in the interior of the classroom or other space to confirm if the lock mechanism is in the locked or unlocked position, thereby allowing the occupants to know if the door is secure or not secure.

SUMMARY OF THE INVENTION

An embodiment of the invention is directed to a door lock indicator which can be used by occupants in the interior space to confirm if the lock mechanism is in the locked or unlocked position, thereby allowing the occupants to know if the door is secure or not secure.

An embodiment is directed to a door lock indicator wherein the door lock indicator is depressed when the lock mechanism is in the locked position.

An embodiment is directed to a door lock indicator wherein a visual indicator is activated when the lock mechanism is in the locked position.

An embodiment is directed to a door lock in which the inside lever must always be free, the door lock having a door lock indicator which can be used by occupants in the interior space to confirm if the lock mechanism is in the locked or unlocked position, thereby allowing the occupants to know if the door is secure or not secure.

An embodiment is directed to a method of determining if an outside lever of a door lock is locked or not locked without the need to physically engage the outer lever, the method including engaging an indicator button and depressing the indicator button to determine that the outside lever is locked.

An embodiment is directed to a door lock indicator for use by occupants in an interior space to confirm if a lock of a door handle of a door is in a locked or an unlocked position. An inside handle of the door handle must always be free to open the door for immediate exit. The door lock indicator includes an indicator mechanism having an end surface. A lock chassis is movable between the locked position and the unlocked position. The lock chassis has a locking mechanism which moves between a first position when the door handle is in the unlocked position and a second position when the door handle is in the locked position. When the locking mechanism is in the first position, the locking mechanism aligns with the indicator mechanism to provide an indication that the door handle is in the unlocked position. When the locking mechanism is in the second position, the locking mechanism does not align with the indicator mechanism to provide an indication that the door handle is the locked position.

An embodiment is directed to a door knob in which an inside handle must always be free to open the door for immediate exit even if a door lock is in a locked position. The door knob including an indicator mechanism having an end surface. A lock chassis is movable between a locked position and an unlocked position. The lock chassis has an outside surface with an opening provided therein, the opening being dimensioned to receive the end surface of the indicator mechanism therein. A locking mechanism which moves between a first position when the door lock is in the locked position and a second position when the door lock is in the unlocked position. The locking mechanism does not align with the indicator mechanism when the door lock is in the locked position and the locking mechanism aligns with the indicator mechanism when the door mechanism is in the unlocked position. When the indicator mechanism is inserted into the opening, the operator receives a positive indication that the lock is in the locked position.

An embodiment is directed to a method of determining if a lock mechanism of a door knob is locked or not locked without the need to physically engage an outer handle of the door knob. The method includes: engaging an indicator mechanism; and depressing the indicator mechanism to determine if the lock mechanism is locked. If the indicator mechanism is able to be fully depressed, the lock mechanism is in the locked position and if the indicator is not able to be fully depressed, the lock mechanism is not in the locked position.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
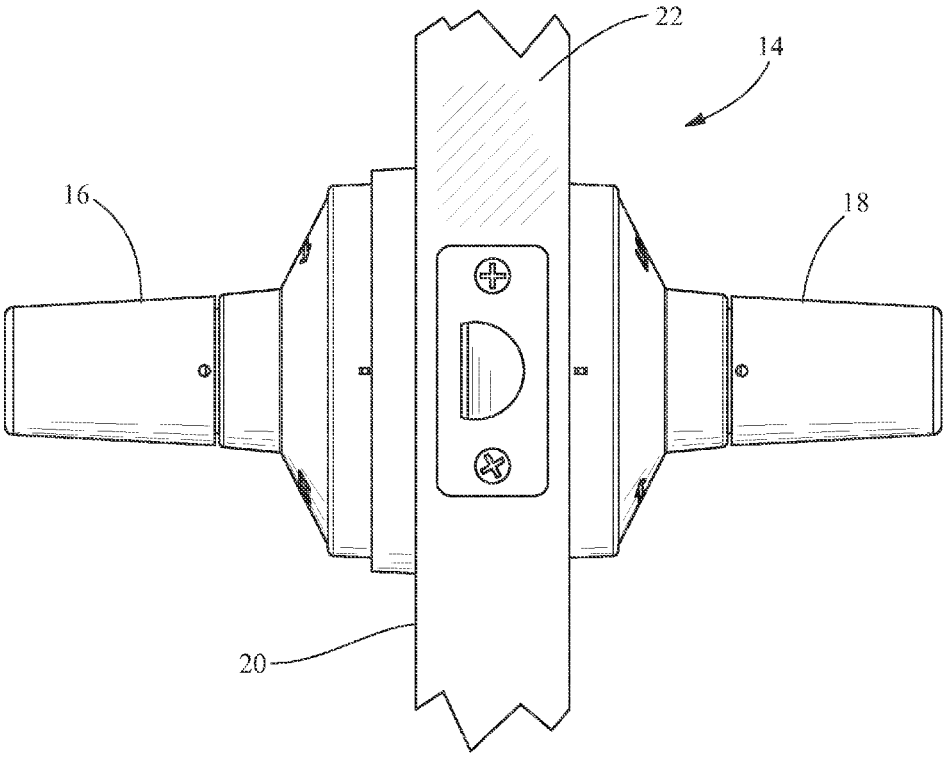
FIG. 1 is a side view of a door with a lock mechanism according to the present invention.

The description of illustrative embodiments according to the principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as any derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the embodiments shown. Accordingly, the invention expressly should not be limited to such preferred embodiments illustrating some possible non-limiting combination of features that may exist alone or in other combinations of features; the scope of the invention being defined by the claims appended hereto.

As shown in the illustrative embodiments shown in FIGS. 1 through 11, a door lock indicator 10 is provided which can be used by occupants in the interior of the classroom or other space to confirm if the lock mechanism 12 of a door handle 14 of a door is in the locked or unlocked position, thereby allowing the occupants to know if the door handle 14 and the door are secure or not secure. The indicator 10 is beneficial in many applications, including, but not limited to, when, for safety reasons, the inside lever or handle 16, must always be free to open the door for immediate exit, whether the outside lever 18 is locked or unlocked. The indicator 10 allows the occupants to insure that the door is locked, preventing unwanted intruders from entering the secured space.

In the illustrative embodiment shown in FIGS. 1 through 11, the door lock indicator 10 is a battery powered device. However, the door lock indicator 10 may be powered by other means without departing from the scope of the invention. The door lock indicator 10 installs on the inside 20 of the door 22, with a visual/audio indicator 24, such as but not limited to, an LED and indicator button or mechanism 26 extending through a base plate 27 of the door handle 14 which extends from the inside 20 of the door 22 to allow an operator to view the visual indicator 24 and engage the indicator mechanism 26. This allows the operator located inside the room to press the indicator mechanism 26. Pressing the indicator mechanism 26 illuminates the visual indicator 24 when the outside lever 18 is secure. Pressing the indicator mechanism 26 will not illuminate the visual indicator 24 if the outside lever 18 is not secure or unlocked. This allows the operator, positioned in the room to quickly and accurately determine if the door 22 is locked from the outside, thereby preventing entrance into the room from the outside and securing the room from unwanted intruders. The door lock indicator 10 is a supplement to a traditional lock chassis, such as, but not limited to the 135 chassis manufactured and sold by PDQ Industries.

Figure 12:
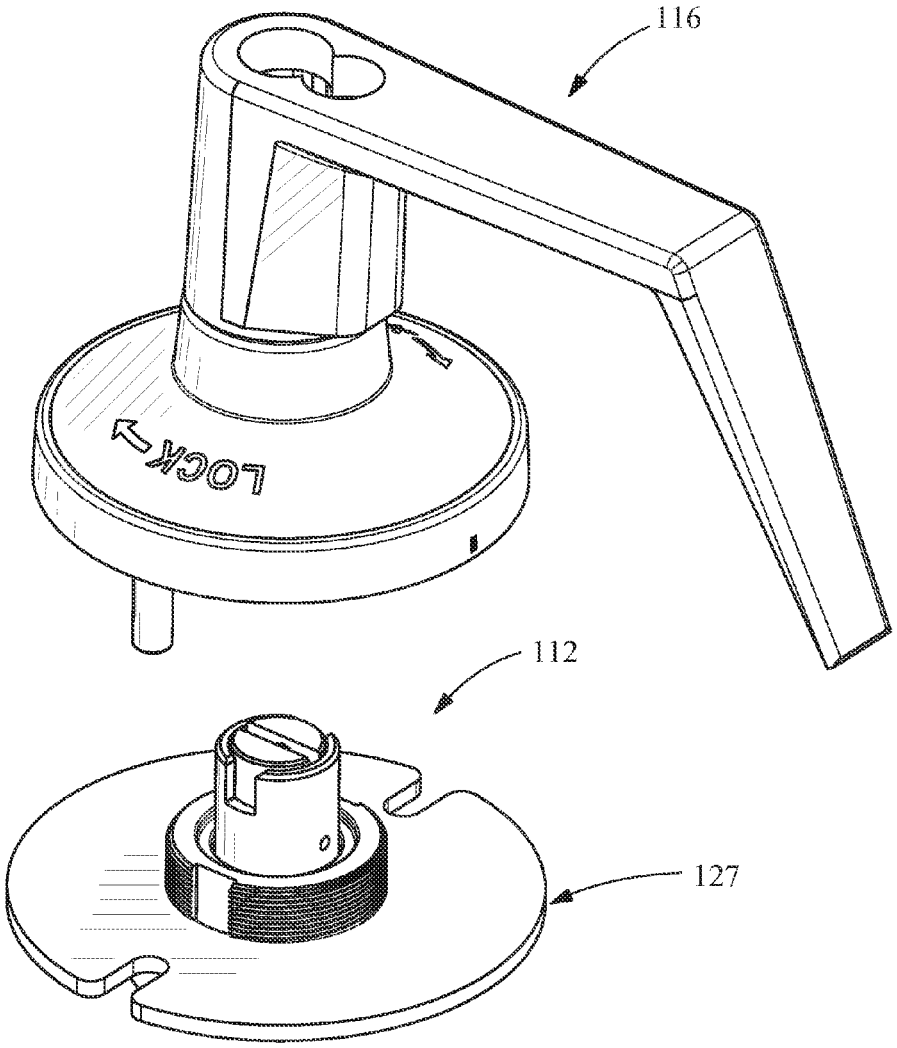
FIG. 12 PRIOR ART
FIG. 12 is a perspective view of a prior art device, showing the handle removed from the base plate.

Prior art lock mechanisms 112, such as shown in FIG. 12, generally use a key on either side of the door (not shown) to lock/secure or unlock the outside lever (not shown). The inside lever 116 is always free/unlocked for immediate exit. Using the outside key to secure the outside lever is a simple process because the operator/individual can try to move the lever confirming it is either locked or unlocked. Using the inside key to lock the inside lever 116 is more difficult because the operator/individual is removed from the locking lever. Consequently, as the inside lever 116 must always be free, the operator/individual cannot determine from the inside lever 116 if he/she has successfully locked the door. Therefore, with prior art lock mechanisms 112, the operator/individual would have to open the door and physically attempt to rotate the outside lever to determine if the door is properly locked. This is not practical or safe in all circumstances.

Referring again to the illustrative embodiment shown in FIGS. 1 through 11, the use of the door lock indicator 10 of the present invention allows any operator/individual inside the room to verify if the outside lever 18 is either locked or not locked without the need to physically engage the outside lever 18. The operator/individual depresses the indicator mechanism 26 located near the door face of the inside 20 of the door 22. In the embodiment shown, the indicator mechanism 26 is in line with the inside lever 16, but other configurations can be used without departing from the scope of the invention. If the outside lever 18 is not locked, an outside surface 23 of a locking member 25 of the lock mechanism 12 is in a first position in which the outside surface 23 of a locking member 25 engages an inside end surface 30 of the indicator mechanism 26, preventing the indicator mechanism 26 from being fully depressed. This provides a mechanical indication that the outside lever 18 is not locked. In addition, if the indicator mechanism 26 is not fully depressed, the LED or other visual/audio device 24 will not illuminate or sound, as more fully described below. As the visual indicator 24 does not illuminate, a visual indication is provided to verify that the outside lever 18 is not locked. Conversely, if the outside lever 18 is locked, the outside surface 23 of the locking member 25 is moved to a second position which is out of alignment with the inside end surface 30 of the indicator mechanism 26, allowing the indicator mechanism 26 to be fully depressed into opening 32. In this position, the inside end surface 30 is positioned in the opening 32 and the engagement portion 34 of the indicator mechanism 26 is moved against or proximate to a surface 36 of the base plate 27, such that the indicator mechanism 26 is fully depressed. This provides a mechanical indication that the outside lever 18 is locked. In addition, if the indicator mechanism 26 is fully depressed, the amount of travel of the indicator mechanism 26 releases an internal switch mechanism 38 illuminating the visual indicator 24, providing a visual indication that the outside lever 18 is locked.

Figure 2:
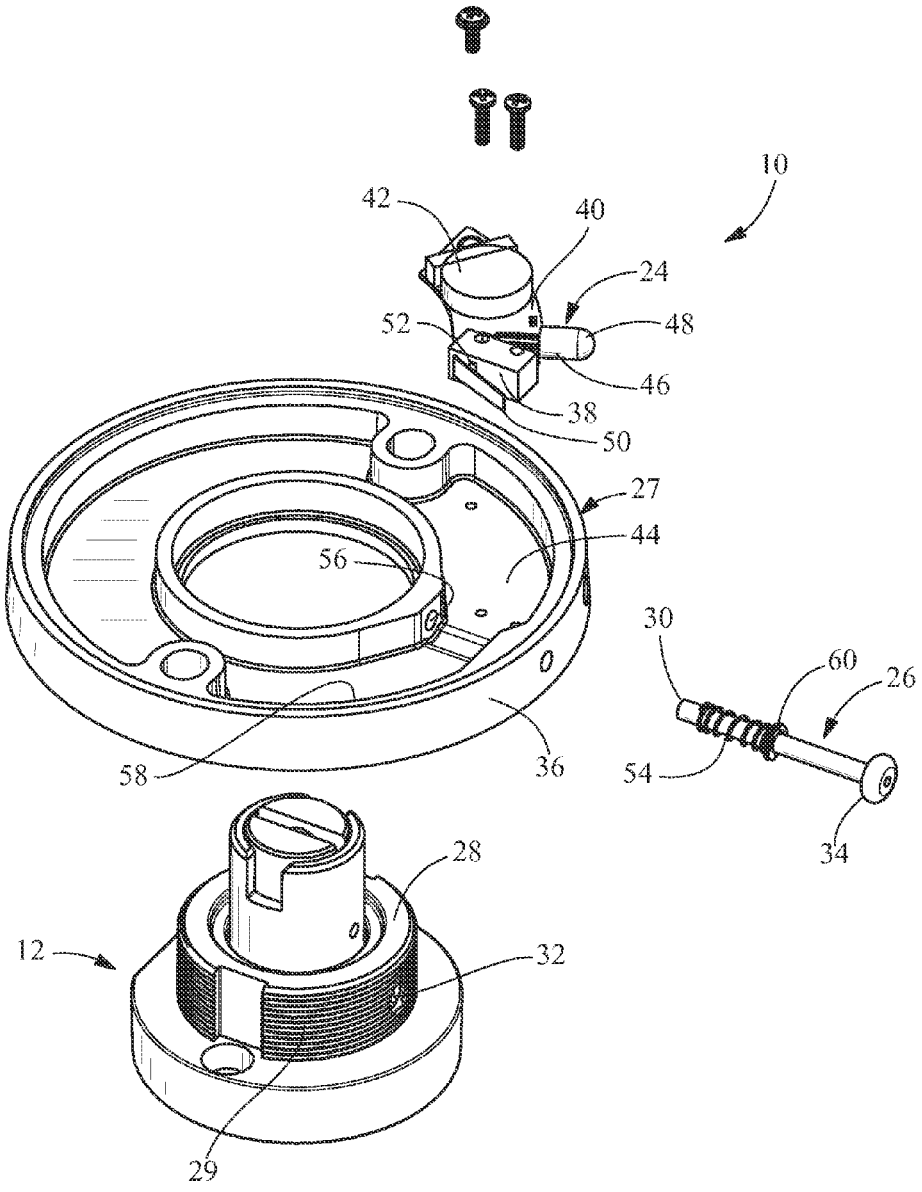
FIG. 2 is an exploded perspective view of a base plate of a lock mechanism of an illustrative embodiment of the invention showing an indicator button, a circuit board and a chassis exploded therefrom.
Figure 6:
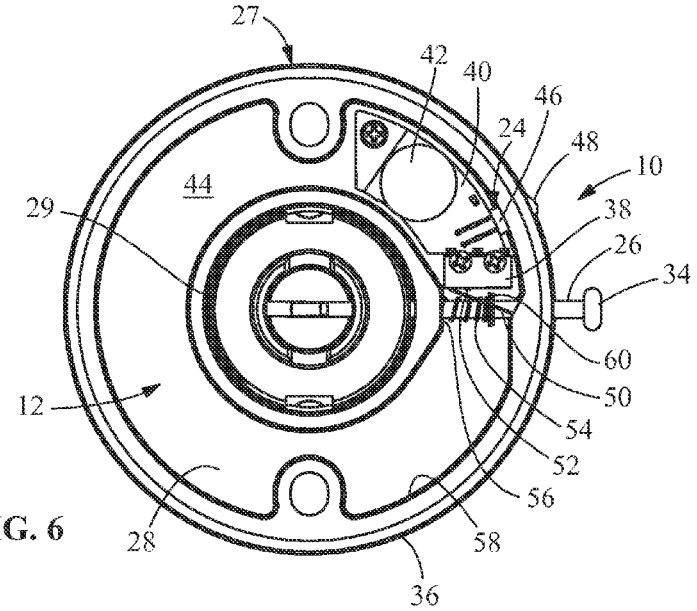
FIG. 6 is a cross-sectional view of the assembled base plate of FIG. 2 showing the indicator button in an engaged and partially depressed position which is realized when the lock mechanism is in an unlocked position.
Figure 7:
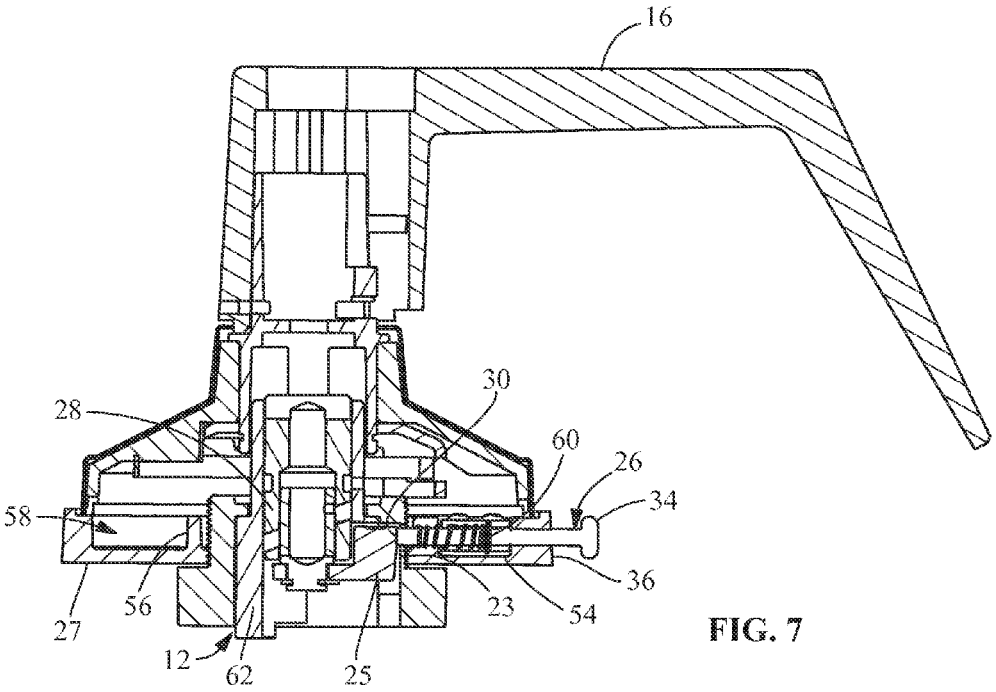
FIG. 7 is a partial cross-sectional view of the lock mechanism and a handle showing the indicator button in the engaged and partially depressed position of FIG. 6.
Figure 8:
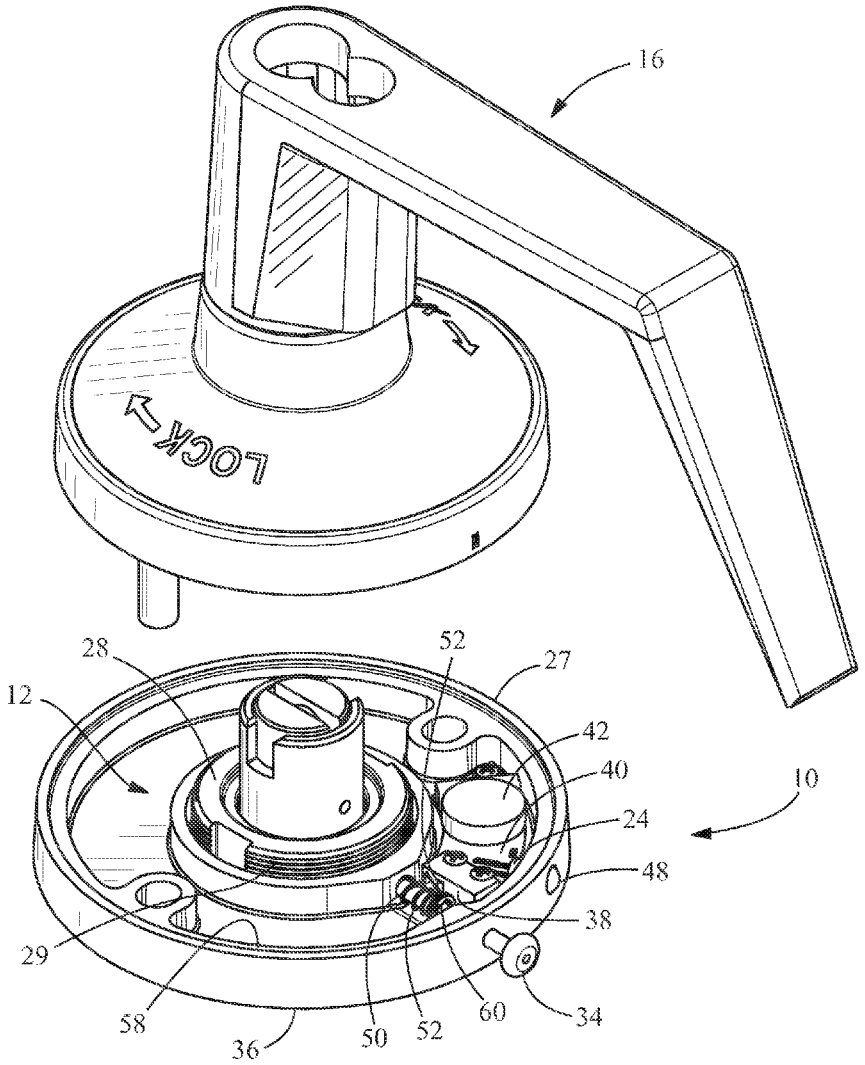
FIG. 8 is a perspective view of the handle and base plate of FIG. 7 with the handle removed to show the indicator button, the circuit board, and the chassis.

The door lock indicator 10, as shown in FIGS. 1 through 11, is an assembly including the visual indicator 24, the indicator mechanism 26, the base plate 27, the switch mechanism 38, additional circuitry 40 (such as, but not limited to, a printed circuit board), and the modified lock chassis 28. The base plate 27 replaces the standard stamped steel mounting plate 127 of the prior art (FIG. 12). The base plate 27 threads onto the modified chassis 28 aligning the indicator mechanism 26 with the opening 32, as best shown in FIGS. 2 and 8. In the illustrative embodiment shown, the base plate 27 houses the printed circuit board 40 with a power source 42 (such as, but not limited to, a coin cell battery), the visual indicator 24 (such as, but not limited to, a light emitting diode or LED) and the switch mechanism 38 (such as, but not limited to, a snap acting micro switch). While a visual indicator 24 is shown and described, the visual indicator may be replaced or supplemented with an audio indicator. The audio indicator may operate in a similar manner to the visual indicator, with the exception that the audio indicator would generate acoustic signals rather than visual signals.

The circuitry 40 is mounted to the base plate 27 using known means, such as, but not limited to, frictional engagement, screws or tabs. The power source 42 is removably held within the base plate 27 by known means, such as, but not limited to, springs or brackets. The switch mechanism 38 is positioned and mounted on the circuitry 40 or on a surface 44 of the base plate 27. A portion 46 of the visual indicator 24 is located within base plate 27, with a portion 48 extending through a surface 36 of the base plate 27 to allow for perception of the optical emissions of the visual indicator 24 by the operator/user.

Figure 3:
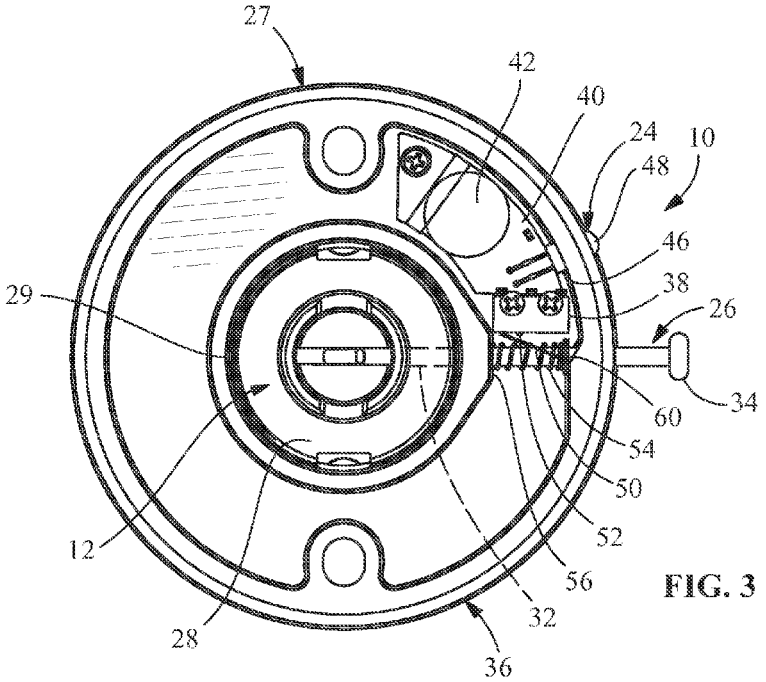
FIG. 3 is a cross-sectional view of the assembled base plate of FIG. 2 showing the indicator button in a non-engaged position.
Figure 9:
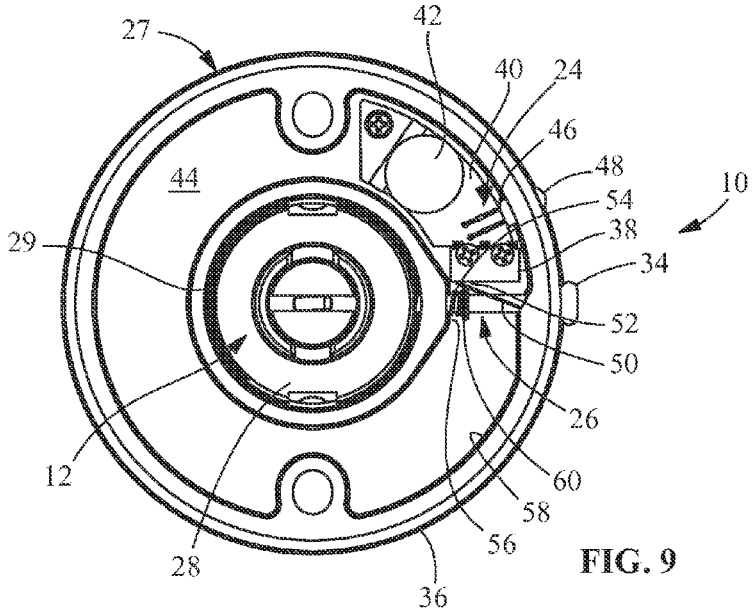
FIG. 9 is a cross-sectional view of the assembled base plate of FIG. 2 showing the indicator button in an engaged and fully depressed position which is realized when the lock mechanism is in a locked position.

As shown in FIGS. 3, 6 and 9, a switch arm 50 of the switch mechanism 38 includes a conventional spring return mechanism 52 causing the switch arm 50 to return to its initial position, in which the electrical circuit is not complete, when the indicator mechanism 26 is not depressed. As shown in FIG. 3 the arm of the switching mechanism extends radially towards the indicator mechanism 26 and is positioned such that it will be depressed by the depression of the indicator mechanism 26. Other embodiments of the switch mechanism 38 and operation thereof can be used without departing from the scope of the invention.

The indicator mechanism 26 includes a spring 54 which is positioned between a first wall 56 and a circular member 60 mounted on the indicator mechanism 26. As viewed in FIG. 3, the circular member 60 is positioned proximate a second wall 58 of the base plate 27 when the indicator mechanism 26 is not depressed. When the indicator mechanism 26 is depressed, the circular member 60 is moved toward the first wall 56, causing the spring 54 to compress. As the indicator mechanism 26 is released, the spring 54 returns to an unstressed position or toward an unstressed position, causing the spring 54 to return the circular member 60 and the indicator mechanism 26 to their initial and fully extended position, as shown in FIG. 3.

Figure 4:
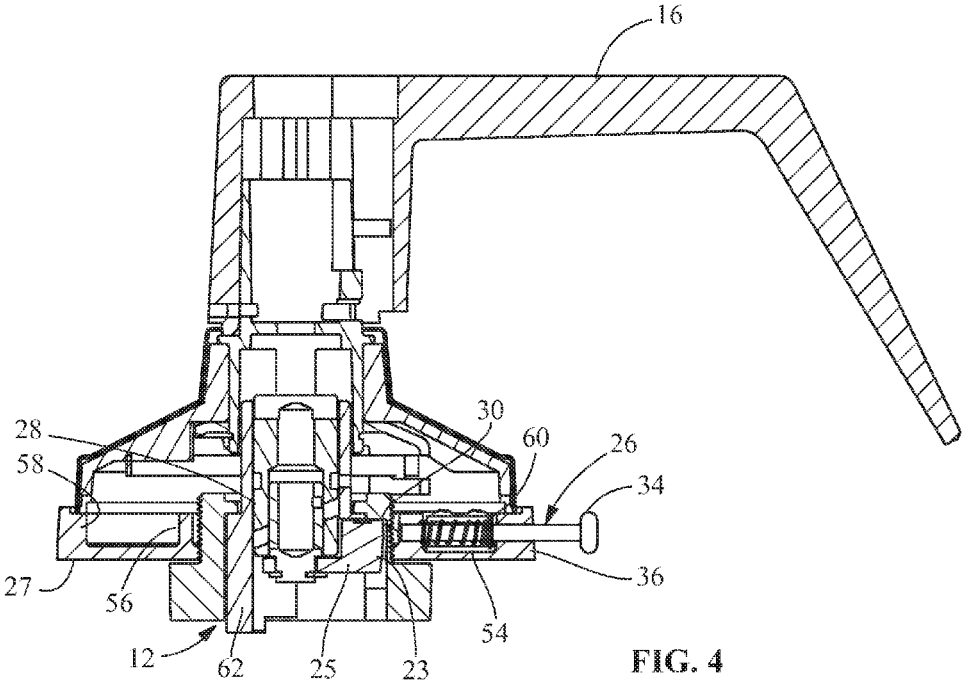
FIG. 4 is a partial cross-sectional view of the lock mechanism and a handle showing the indicator button in the non-engaged position of FIG. 3.
Figure 5:
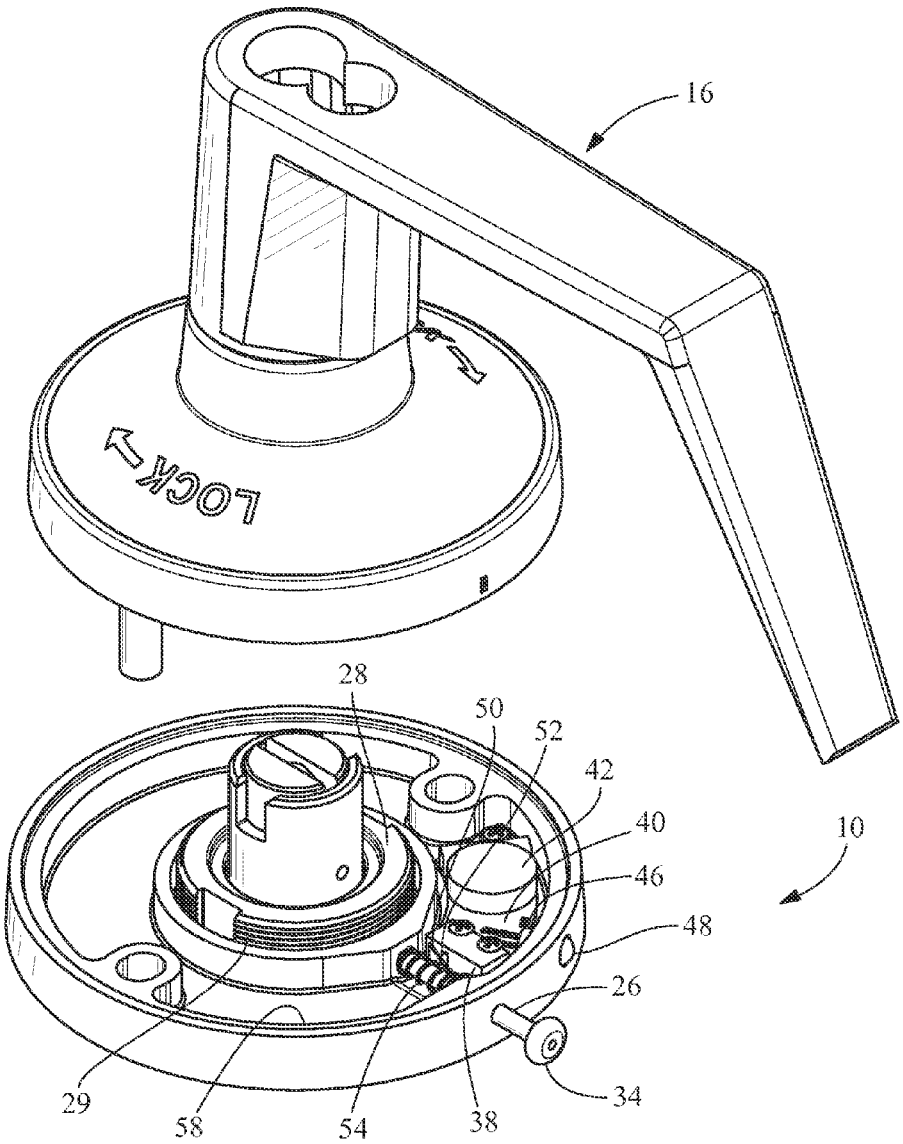
FIG. 5 is a perspective view of the handle and base plate of FIG. 4 with the handle removed to show the indicator button, the circuit board, and the chassis.

As shown in FIGS. 3 through 5, when at rest or not depressed, the indicator mechanism 26 is fully extended. In this state the switch arm 50 is closed and the switch mechanism 38 is open, thereby preventing the electrical circuit from being closed. As the electrical circuit between the power source 42 and the visual indicator 24 is not complete, the visual indicator 24 is not illuminate.

As shown in FIGS. 6 through 8, when the outside lever 18 is not locked and the indicator mechanism 26 is depressed, the indicator mechanism 26 moves only a small amount, as the further movement of the indicator mechanism 26 is prevented by the engagement of the end surface 30 with the outside surface 23 of the locking member 25. In this position, a portion of the locking member 25 is aligned with the opening 32 of the lock chassis 28 to prevent the indicator mechanism 26 from being fully inserted into the opening 32. This prevents the indicator mechanism 26 from being fully depressed. The limited travel indicates to the individual that the outside lever 18 is not locked. The limited indicator button travel is not sufficient to change the state of the switch mechanism 38. Therefore, the electrical circuit between the power source 42 and the visual indicator 24 remains open and the visual indicator 24 is not illuminated.

Figure 10:
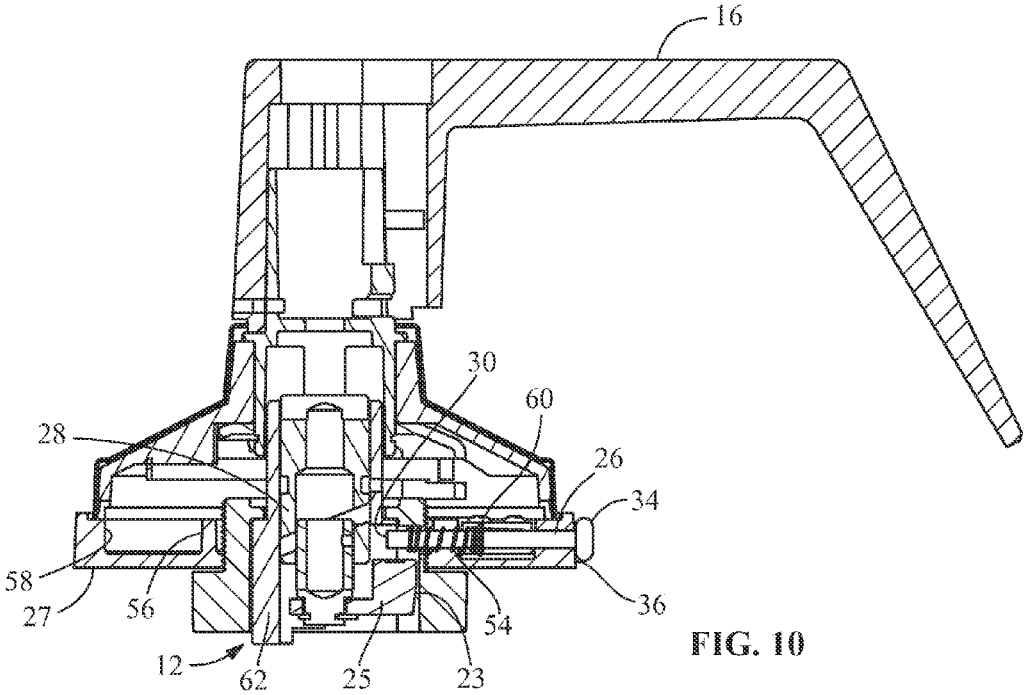
FIG. 10 is a partial cross-sectional view of the lock mechanism and a handle showing the indicator button in the engaged and fully depressed position of FIG. 9.
Figure 11:
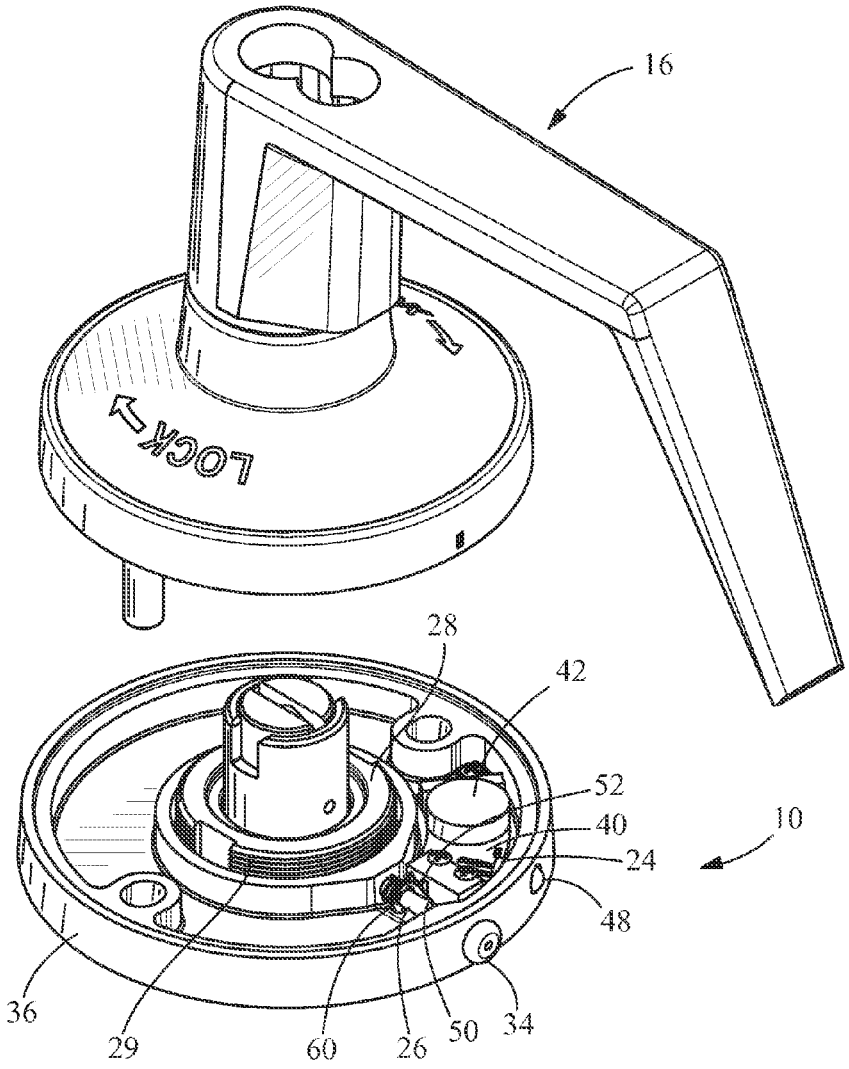
FIG. 11 is a perspective view of the handle and base plate of FIG. 10 with the handle removed to show the indicator button in a fully depressed position, the circuit board, and the chassis.

As shown in FIGS. 9 through 11, when the outside lever 18 is locked and the indicator mechanism 26 is depressed, the locking mechanism 25 is moved out of alignment with the opening 32, allowing the end surface 30 of the indicator mechanism 26 to be moved past the locking mechanism 25 and allowing the engagement portion 34 of the indicator mechanism 26 to move against or proximate to the surface 36 of the base plate 27. In this position the spring 54 is compressed and the indicator mechanism 26 is fully depressed. For purposes of the description, fully depressed includes when the indicator mechanism 26 is moved into the opening 32 in the lock chassis 28, regardless of whether the end surface 30 of the indicator mechanism 26 abuts against an end surface of the opening 32 or the end surface 30 of the indicator mechanism 26 is positioned proximate to the end surface of the opening 32. This provides a mechanical indication that the outside lever 18 is locked. In addition, the full displacement of the indicator mechanism 26 is sufficient to change the state of the switch mechanism 38, allowing the electrical circuit between the power source 42 and the visual indicator 24 to be complete, causing the visual indicator 24 to illuminate. The visual indicator 24 continues to be illuminated as the indicator mechanism 26 is fully depressed, providing a visual indication that the outside lever 18 is locked. Alternatively, the circuitry which cooperates with the visual indicator 24 may be programmed to allow the visual indicator 24 to remain illuminated for a defined period of time after the indicator mechanism 26 has been fully depressed.

The known type of chassis, as represented in FIG. 12, uses a key in either lever to rotate a cam in the outside hub of the chassis. The cam translates the rotational motion to linear motion driving a locking tip away from the chassis center where it locks the outside lever spindle to the outside hub making the outside lever immovable and secure. To unlock the outside lever the cam is rotated in reverse pulling the locking tip back toward the center of the chassis releasing the lever spindle. The inside hub of a standard chassis is a mirror image of the outside hub with one exception; the inside hub does not have a locking tip to secure the lever spindle leaving the inside lever free for exit at all times.

The chassis of the present invention adds the locking mechanism 25 to the inside hub with a modified lever spindle 62. The modified lever spindle 62 has extra material removed allowing it to rotate regardless of the locking member position. As previously described, the indicator button 26 will abut the surface 23 of the locking member 25 if the outside lever is unlocked. Alternatively, the indicator 26 bypasses the locking member 25 when the outside lever is locked.

While the embodiment shown describes a mechanical indicator, other types of indicators, such as, but not limited to, electrical and electro-mechanical devices may be used.

In addition, in other embodiments the lock mechanism 12 may operate differently. In one such example, when the outside lever 18 is not locked, the outside surface 23 of the locking member 25 may be moved to the second position which is out of alignment with the inside end surface 30 of the indicator mechanism 26, allowing the indicator mechanism 26 to be fully depressed into opening 32. Conversely, if the outside lever 18 is locked, the outside surface 23 of the locking member 25 of the lock mechanism 12 may be moved to the first position in which the outside surface 23 of a locking member 25 engages an inside end surface 30 of the indicator mechanism 26, preventing the indicator mechanism 26 from being fully depressed.

While the invention has been described with reference to a preferred embodiment, it will be understood by those skilled in the art that various changes may be made and equivalents may be substituted for elements thereof without departing from the spirit and scope of the invention as defined in the accompanying claims. In particular, it will be clear to those skilled in the art that the present invention may be embodied in other specific forms, structures, arrangements, proportions, sizes, and with other elements, materials, and components, without departing from the spirit or essential characteristics thereof. One skilled in the art will appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims, and not limited to the foregoing description or embodiments.

The invention claimed is:

1. A door lock indicator for use by occupants in an interior space to confirm if a lock of a door handle of a door is in a locked or an unlocked position, an inside handle of the door handle must always be free to open the door for immediate exit, the door lock indicator comprising:

an indicator mechanism having an end surface;

a lock chassis movable between the locked position and the unlocked position, the lock chassis having a locking mechanism which moves between a first position when the door handle is in the unlocked position and a second position when the door handle is in the locked position;

wherein when the locking mechanism is in the first position, the locking mechanism aligns with the indicator mechanism to allow the indicator mechanism to provide an indication that the door handle is in the unlocked position; and wherein when the locking mechanism is in the second position, the locking mechanism does not align with the indicator mechanism to provide an indication that the door handle is in the locked position.

2. The door lock indicator of claim 1, wherein a visual indicator is activated when the lock mechanism is not aligned with the indicator mechanism and the indicator mechanism is moved into an opening of the lock chassis, thereby proving the indication that the door handle is in the locked position.

3. The door lock indicator of claim 1, wherein the indicator mechanism is an indicator button which has a spring attached thereto, wherein the indicator button is returned to an unstressed position when the indicator button is not depressed by the occupant.

4. The door lock indicator of claim 2, wherein the visual indicator is an LED.

5. The door lock indicator of claim 2, wherein as the indicator mechanism is inserted into the opening, a switch mechanism is closed allowing an electrical circuit between a power source and the visual indicator to be complete, causing the visual indicator to illuminate.

6. The door lock indicator of claim 5, wherein the power source is a battery.

7. The door lock indicator of claim 2, wherein the indicator mechanism and the visual indicator are positioned in a base plate of the door handle on an interior surface of the door.

8. A door knob in which an inside handle must always be free to open the door for immediate exit even if a door lock is in a locked position, the door knob comprising:

an indicator mechanism having an end surface;

a lock chassis movable between the locked position and an unlocked position, the lock chassis having an outside surface with an opening provided therein, the opening being dimensioned to receive the end surface of the indicator mechanism therein;

a locking mechanism which moves between a first position when the door lock is in the locked position and a second position when the door lock is in the unlocked position;

the locking mechanism does not align with the indicator mechanism when the door lock is in the locked position and the locking mechanism aligns with the indicator mechanism when the door lock is in the unlocked position;

wherein when the indicator mechanism does not engage the locking mechanism, an operator receives a positive indication that the door lock is in the locked position.

9. The door lock indicator of claim 8, wherein a visual indicator is activated when the lock mechanism is in the locked position and the indicator mechanism is inserted into the opening.

10. The door lock indicator of claim 9, wherein as the indicator mechanism is inserted into the opening a switch mechanism is closed allowing an electrical circuit between a power source and the visual indicator to be complete, causing the visual indicator to illuminate.

11. The door lock indicator of claim 10, wherein the indicator mechanism is an indicator button which has a spring attached thereto, wherein the indicator button is returned to an unstressed position when the indicator button is not depressed by the occupant.

12. The door lock indicator of claim 11, wherein the visual indicator is an LED.

13. The door lock indicator of claim 12, wherein the power source is a battery.

14. The door lock indicator of claim 9, wherein the indicator mechanism and the visual indicator are positioned in a base plate of the door handle on an interior surface of the door.

15. A method of determining if a lock of a door knob is locked or not locked without the need to physically engage an outer handle of the door knob, the method comprising:

engaging an indicator mechanism;

depressing the indicator mechanism to determine if the lock mechanism is locked;

wherein if the indicator mechanism is able to be fully depressed, the lock mechanism is in the locked position and if the indicator is not able to be fully depressed, the lock mechanism is not in the locked position.

16. The method of claim 15, comprising:

activating a visual indicator if the indicator mechanism is able to be fully depressed.

17. The method of claim 16, comprising:

depressing a switch mechanism allowing an electrical circuit between a power source and the visual indicator to be complete, causing the visual indicator to illuminate.

18. The method of claim 16, comprising:

returning the indicator mechanism to an unstressed position when the indicator button is not depressed by an occupant.

19. The method of claim 16, wherein the visual indicator is an LED.

20. The method of claim 16, wherein the power source is a battery.

* * * * *